United States Patent [19]

Angelini

[11] 4,419,194

[45] Dec. 6, 1983

[54] METHOD AND APPARATUS FOR CONTINUOUSLY CHROMIUM-PLATING

[75] Inventor: Sergio Angelini, Milan, Italy

[73] Assignee: Brevetti Elettrogalvanici Superfiniture S.R.L., Milan, Italy

[21] Appl. No.: 375,786

[22] Filed: May 6, 1982

[30] Foreign Application Priority Data

May 20, 1981 [IT] Italy ..... 21843 A/81

[51] Int. Cl.[3] ..... C25D 7/00; C25D 17/00

[52] U.S. Cl. ..... 204/25; 204/27; 204/28; 204/51; 204/206; 204/275

[58] Field of Search ..... 204/25, 27, 28, 51, 204/275, 206, 207, 208, 209, 210, 211

[56] References Cited

U.S. PATENT DOCUMENTS

| | | | |
|---|---|---|---|
| 2,341,712 | 2/1944 | Gray | 204/28 |
| 2,370,973 | 3/1945 | Lang | 204/28 X |
| 2,989,445 | 6/1961 | Lloyd et al. | 204/28 |
| 3,642,602 | 2/1972 | Schweizerhof | 204/211 |
| 3,751,344 | 8/1973 | Angelini | 204/28 |
| 3,852,170 | 12/1974 | Angelini | 204/28 |
| 4,072,581 | 2/1978 | Allen | 204/15 |
| 4,102,772 | 7/1978 | Nakamura et al. | 204/206 |

OTHER PUBLICATIONS

A. J. Avila et al., Def. Pub. 667,231, Nov. 18, 1969.

*Primary Examiner*—G. L. Kaplan

*Attorney, Agent, or Firm*—Beveridge, DeGrandi & Kline

[57] ABSTRACT

A method for removing the hydrogen in the continuous chromium-plating process of large bars or long-shaped pieces and the like; according to the invention, the chromium-plating bath is made to recycle under pressure by feeding it into the space inside the chromium-plating anode and directing the jets of chromium-plating fluid towards the surfaces of the pieces during the passage inside the anode itself. This invention concerns moreover, a double-tank apparatus with a double sealing system at both ends and with a system for recycling the chromium-plating fluid, from the outer tank to the inner one, inside the anode.

10 Claims, 5 Drawing Figures

METHOD AND APPARATUS FOR CONTINUOUSLY CHROMIUM-PLATING

BACKGROUND OF THE INVENTION

This invention concerns the continuous chromium-plating of bars, long pieces of variable sizes and cross-sections, and the like, which foresees the use of a particular system for removing the hydrogen formed during the chromium-plating process which would otherwise tend to adhere to the surfaces of the pieces, in the portion of the path delimited by the chromium-plating electrode allowing an even deposit of the chromium itself.

This invention concerns, moreover, a double-tank apparatus, in particular for hard, or thick, chromium-plating of bars, meaning by this, large elongated pieces having either a continuous or variable profile, such apparatus being provided with a double sealing device for recovering the chromium-plating fluid, and with a system for recycling the chromium-plating fluid, in order to eliminate deposits of hydrogen on the surfaces of the bars, in the portion of the path delimited by the chromium-plating anode. There are known apparatuses for continuously chromium-plating bars and the like, which foresee the use of a system of tanks through which the bar or series of bars, to be chromium-plated, travel; however, the known types of apparatuses are very rarely suitable for hard or thick chromium-plating of large-sized pieces due to the problem of the hydrogen which is generated in the chromium-plating bath. This is a serious draw-back because this hydrogen tends to adhere to the surfaces of the piece to be chromium-plated, in the portion of the path defined by the chromium-plating anode, preventing an even deposit of chrome. This problem is particularly serious with bars or pieces of large dimensions having a variable or non-circular cross-sectional profile, because of the tendency of the hydrogen to adhere to the downward facing surfaces of the bar, due to the impossibility of rotating bars or pieces of a considerable length and which may be as wide as 30–40 cm or more.

With apparatuses of the aforementioned type, there is also the problem of ensuring a perfect seal at the bar entrance and exit ends of the chromium-plating tanks, insofar as this seal is difficult to achieve due to the very nature and properties of the chromium-plating bath, together with the fact that in pieces or bars with particular cross-sectional shapes, the profile may vary abruptly along the axis of the bar or of the piece itself. It is obvious that in such conditions the chromium-plating fluid could suddenly overflow from the tank, with a consequent serious danger for the objects and personnel in charge of the chromium-plating plant.

These problems have never been tackled and solved in practice or in such a way as to ensure the proper functioning of the apparatus in order to achieve a perfect chromium-plating of bars or pieces in general, providing a constant and even layer of chrome over the entire surface of the piece itself.

A scope of this invention is to provide a method for eliminating the hydrogen in a chromium-plating bath for bars and pieces of large dimensions, which makes it possible to obtain a layer of chrome of homogenous thickness on pieces to be chromium-plated, by eliminating the serious problem caused by the adhesion of hydrogen to the piece itself.

A further scope of this invention is to provide an apparatus by means of which it is possible to carry out the above-described method, which apparatus is provided with a recycling system and a double tank with sealing means on the sides, in order to prevent any overflow of fluid whatsoever, and at the same time fitting itself to pieces or bars of variable cross-sectional shapes and sizes.

SUMMARY OF THE INVENTION

According to this invention, there is a method for eliminating the hydrogen in the continuously chromium-plating of bars or pieces having either constant or variable cross-sectional profiles, in which the bar is made to move forward along a rectilinear path, inside an anode immersed in a chromium-plating bath, and in which the level of the fluid in the chromium-plating bath is kept at a constant height, said chromium-plating fluid being continuously recirculated, feeding it under pressure directly into the space within the chromium-plating anode and directing the jets of chromium-plating fluid towards surfaces of the aforesaid bar. The apparatus, according to this invention, comprises a first tank containing a chromium-plating bath, situated inside a second tank, the tanks having lateral walls provided with apertures for the passage of bars, said aperture being aligned with a chromium-plating anode, and sealing means in correspondence with the aforesaid apertures, for retaining the chromium-plating fluid and for conveying it into the outer tank, the apparatus comprising moreover, a system for recycling the chromium-plating fluid from the outer tank to the inner tank, said system having feeding nozzles arranged in correspondence with apertures in the chromium-plating anode and facing towards the inside of the anode itself, for directing the chromium-plating fluid towards the bar to be chromium-plated.

BRIEF DESCRIPTION OF THE DRAWINGS

The invention will be described in greater detail hereunder, with reference to the example of the accompanying drawings, in which.

DESCRIPTION OF THE INVENTION

Figure 1:
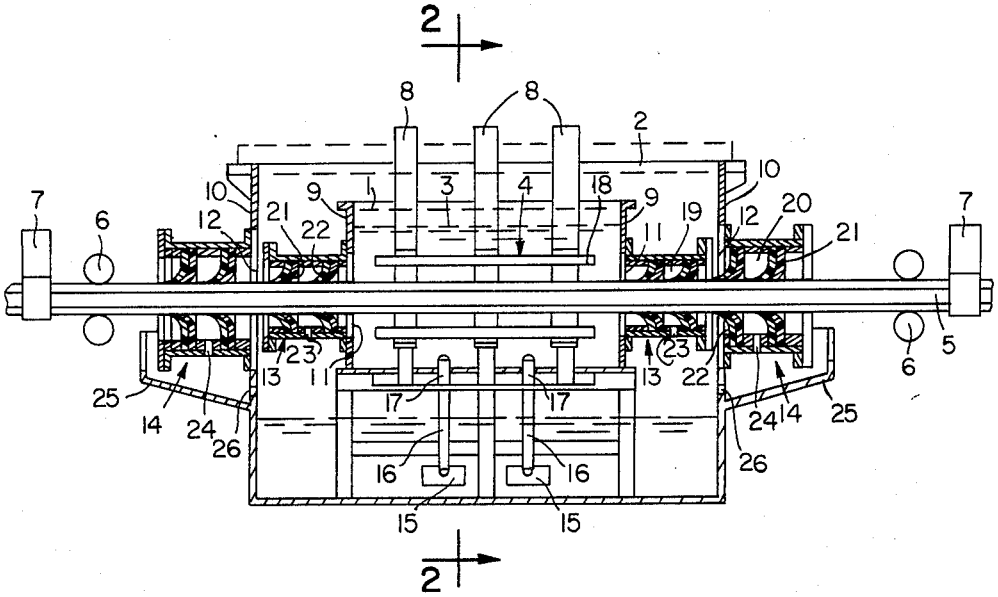
FIG. 1 shows, in longitudinal section, a view of the apparatus, according to one embodiment.
Figure 2:
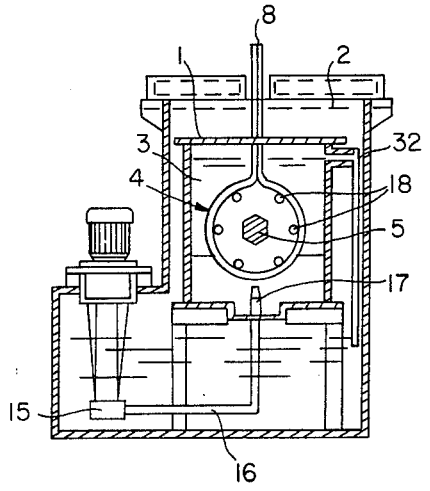
FIG. 2 is a cross-sectional view along the line 2—2 of FIG. 1, to show an embodiment of the chromium-plating anode.

With reference to the figures, and in particular to FIGS. 1 and 2 of the accompanying drawings, we will describe a possible embodiment of an apparatus according to the invention; in particular, the apparatus is designed for hard or thick chromium-plating of bars in general, meaning by the expression "bar" any piece to be chromium-plated, solid or hollow, with a length greater than the transversal dimensions, and whose profile may either be constant or may vary with even sudden variations in the cross-section thereof.

With reference to the aforesaid figures, the apparatus comprises a first or inner chromium-plating tank 1, situated inside a second or external tank 2 which encircles and encloses it completely. In the inner tank 1, the chromium-plating tank, there is a chromium-plating bath 3 in which is immersed a chromium-plating electrode 4 inside which moves each bar 5 to be chromium-plated, as shown. The bar 5 is supported in any suitable manner, for example by means of rollers 6 made to rotate, which cause the bar to slowly move forward with a constant speed, in order to achieve an even layer of chromium, of the desired thickness, according to the various specific requirements. References 7 and 8 respectively indicate the electric contact elements with the bars 5 and respectively for the anode 4, through which the chromium-plating electric current is fed.

Each tank 1 and 2 presents lateral walls 9 and respectively 10, made with wide apertures 11 and 12 for the passage of the bars 5, axially aligned with the anode 4, into the tank 1; in order to prevent overflows of chromium from the tanks 1 and 2, in correspondence with each aperture 11 and 12, a special sealing device 13 and respectively 14 is provided, of the movable-element type, as described further on with reference to the remaining figures. The apparatus comprises moreover a system for recycling the chromium-plating fluid which flows from the tanks 1 and 2 through the apertures 11 and 12, is totally restrained by the seals 13, 14 and conveyed into the outer tank 2, and made to return to the chromium-plating tank 1, in order to have the latter tank with a chromium-plating bath 3 of a continuously constant level and in order to remove the hydrogen from the surfaces of pieces to be chromium-plated, as hereintofore described.

The recycling system for the chromium-plating fluid, comprises one or more recycling pumps 15 (FIG. 2) which suck the fluid from the bottom of the outer tank 2 and feed it, under pressure, through separate ducts 16 and nozzles 17. The nozzles 17 are situated in the inner tank 1, and feed the fluid directly into the space inside the chromium-plating anode 4, directing the jets of chromium-plating fluid towards the bars 5, in the portion of the path delimited by the anode 4.

Figure 3:
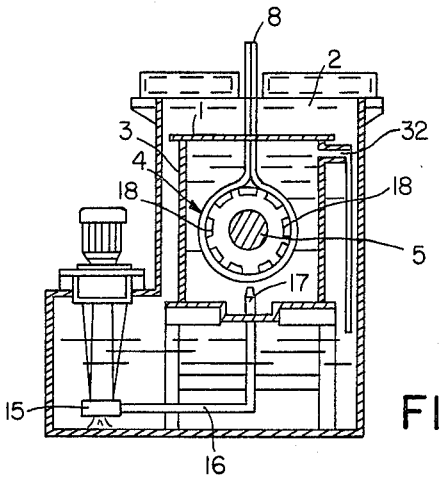
FIG. 3 shows a section similar to that of the previous figure, for a second embodiment of the chromium-plating anode.

In this connexion, as shown in the first two figures, the chromium-plating anode 4, unlike the anodes normally used, consists of rods 18 having a suitable shape to the cross-section of the bars 5 to be chromium-plated; the rods 18 are arranged in a circle around the bar itself, as shown, leaving a sufficient space between one bar and the next for the passage of the jets of chromium-plating fluid produced by the nozzles 17. The rods 18 of the anode are arranged parallel to one another and to the moving direction of the bar 5, said rods being fixed, for example welded, to the electric elements 8, in the form of copper strips, for connecting the aforementioned anode to a source of direct current. FIGS. 2 and 3 of the accompanying drawings show two different embodiments of the chromium-plating anode 4, depending upon the geometric shapes of the cross-sections of the bars to be chromium-plated. In particular, it can be seen from FIG. 2, that the rods 18 forming the anode, in the case in which the bar 5 to be chromium-plated, has a substantially ploygonal cross-section, consist of circular-section rods, arranged at regular intervals around the bar 5. Moreover, the rods 18 of FIG. 2 are situated in correspondence with the flat sides of the bar avoiding, therefore, placing them in correspondence with the corners, in order to avoid an excessive concentration of the electric field in the chromium-plating bath, which would cause an uneven layer of chrome on the corners themselves. On the contrary, in the case of FIG. 3, in which the bar 5 to be chromium-plated presents a circular or similar cross-section, the anode 4 consists of rods 18 with a rectangular cross-section. Consequently, in order to avoid localized layers of chromium, it is necessary to pre-arrange the anode with rods having flat or rounded surfaces, in correspondence with rounded or respectively flat surfaces of the piece to be chromium-plated. In the case in which the piece to be chromium-plated presents cross-sections of different shapes and/or sizes, the shape of anode-rod considered most suitable should be adopted.

Figure 4:
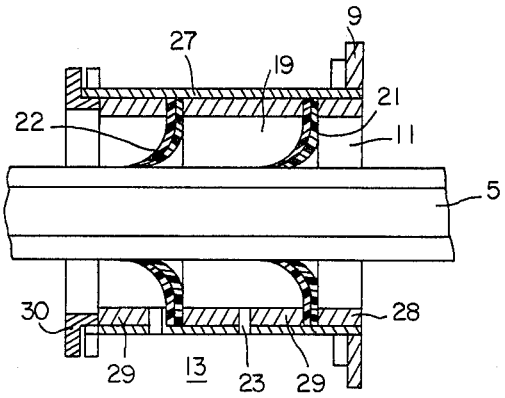
FIG. 4 shows a longitudinal section of a possible embodiment of the seals, for a bar with a constant cross-sectional profile.
Figure 5:
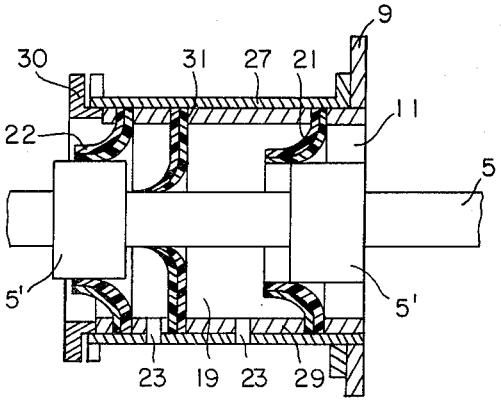
FIG. 5 shows a further possible embodiment of the seals for a piece having a variable cross-sectional profile.

It was stated at the beginning, that the end walls 9 and 10 of the tanks 1 and 2 are provided with sealing devices 13 and respectively 14, shown in FIG. 1 and in detail in FIGS. 4 and 5 of the accompanying drawings. As can be seen in FIG. 1, the sealing devices 13 and 14 both comprise a chamber 19 and 20 for retaining the chromium-plating fluid, each chamber being delimited by at least two sets of washers or sealing elements 21 and 22, for example in the form of discs made of plastic material, such as PVC or the like, with passage apertures for the bars, which apertures fit to the shape and dimension of cross-section of the bars themselves. The bottom of each chamber 19 presents apertures or holes 23 for discharging into the outer tank 2, part of the chromium-plating fluid which flows from the inner tank 1 through a series of sealing elements 22 arranged close to the wall of the aforementioned tank; likewise, the bottom of each chamber 20 presents apertures or holes 24 for discharging, into a vessel 25, situated beneath, and in turn, communicating with the outer tank 2 through an aperture in the lateral walls; therefore, the chromium-plating fluid which partially flows through the chamber of the first sealing device 13, and is conveyed by the bar itself as it moves slowly forward, is returned to the outer tank 2.

A particularly advantageous embodiment of the sealing devices 13 and 14 is shown, merely by way of example, in FIGS. 4 and 5. The bars or pieces 5, to be chromium-plated, may in fact present a continuous profile or cross-section, as shown in FIG. 4, or they may present a variable profile, as shown in FIG. 5, where portions of bars 5 having a first section follow and/or precede portions of bars 5' with a greater and/or different section. Said portions 5' of different section, may also be differently situated along the bar according to the particular cases which usually occur in chromium-plating. It is advantageous therefore to provide a sealing device which can be easily adapted to all situations, and which enables the quick and easy replacement, shifting, addition or removal of the sealing elements 21, 22. For this purpose, each sealing device 13 and 14 comprises a tubular body 27 secured to the lateral wall of the tank, for example screwed onto the wall 9 in correspondence with the aperture 11 through which the bar 5 passes. A first fixed spacer 28, for example welded, is inserted into the tubular element 27 on the side of wall 9 of the tank, whilst further mobile annular spacers 29 for locking the sealing elements 21, 22 are then inserted into the tube 27, arranging the sealing elements or washers 21, 22 between the edges of the opposing ends of two adjacent spacers. A thrust flange 30, or other equivalent means, is bolted onto the opposite end of the tubular body 27, in order to secure the spacers and the aforesaid sealing elements in position. It is evident therefore, from the preceding description and FIGS. 4 and 5, that by varying the number and the lengths of the spacers, it is possible to position the sealing elements 21, 22 in each device 13, 14, in the most appropriate manner and in such a way as to ensure a perfect seal under any conditions whatsoever. In fact, in the case of FIG. 4, the sealing elements 21 and 22 have been arranged at just any distance, insofar as the bar 5 presents a constant section. On the contrary, in the example of FIG. 5, the bar or piece 5 to be chromium-plated presents portions 5' of greater width; consequently, in order to ensure the seal when a portion 5' of the bar begins or terminates to pass through a flexible sealing element, that is to say, under the most critical sealing conditions for the device, an intermediate sealing element 31 is provided between the elements 21 and 22. This arrangement is made possible by using a different number of spacers, with respect to the previously described case, the lengths of which have moreover been suitably calculated so that only one sealing element at a time is in critical condition during the passage of a portion 5' of bar of different dimensions; this occurs for example in the set of sealing elements 21 in FIG. 5 which is about to be penetrated by the portion 5' of bar shown in the figure. The remaining two sealing elements 22 and 31 are, on the contrary, totally in contact with the surface of the bar, thus ensuring a perfect seal. It is clear therefore, that in the case in question, the spacer 29 situated between two adjacent sealing elements, for example, between the elements 21 and 31, must have a greater length than that of the portion of bar 5', for example, approximately double, or so that the distance between two adjacent sealing elements, such as for example for the elements 21 and 31, is kept smaller by providing a spacer equal in length to half the aforementioned portion of bar 5'. It is clear, however, that by varying the length of the supporting tubular body 27, the number and the length of the annular spacers 29, the number and the type of sealing elements 21, 22 and/or 31, and also the dimensions of the aforesaid parts, it is possible to adapt the sealing devices 13 and 14 to all the requirements which in practise occur in chromium-plating large bars or large-sized pieces.

The apparatus operates according to the claimed method, as follows: as the bar 5 is moved slowly, for example, at a speed of a few meters per hour, through the tanks 1, 2 and the chromium-plating anode 4, a layer of chrome is plated on the surfaces of the bar, in the usual way; at the same time, the sealing devices 13 and 14 prevent the fluid from flowing from the tanks, keeping it in the chambers 19 and 20 from where it is discharged into the outer tank 2. As the chambers 19 and 20 defined by the sealing devices 13 and 14 contain a certain amount of chromium-plating fluid, at a temperature of around 50, 52° C., or rather, the chambers 19 are sunstantially full of said fluid, the bars are consequently preheated at the entry side into the chromium-plating tanks, which aids and even improves the chromium-plating process.

As the chromium-plating fluid would continue to flow out of the inner tank 1, collecting on the bottom of the outer tank 2, the level of the chromium-plating bath 3 would tend to diminish; the pumps consequently return the chromium-plating fluid to the inner tank 1, where an overflow device 32 (FIG. 2) keeps it at a constant level. However, according to this invention, in order to eliminate the adhering of hydrogen to the surfaces of the bars to be chromium-plated, especially to the surfaces beneath or which face downwards and to which the bubbles of gas would tend to adhere, the chromium-plating fluid is made to recycle from the outer tank 2 to the inner tank 1, feeding it, under pressure, directly into the space of the chromium-plating anode 4, through single nozzles 17 which direct the jets of fluid towards the bar itself. In this way, any bubbles of hydrogen which may have adhered to the surfaces of the bars and which would tend to hinder the plating of the chrome, are dispelled and continuously removed, thereby ensuring the best possible conditions for chromium-plating. In the case shown, the jets of fluid are injected into the anode space upwards from below, against the bar 5, in two intermediate positions with respect to the length of the anode itself, however, it is obvious that the number, position and direction of the nozzles 17, with respect to the bar 5, may also vary or be modified, with respect to that shown, whilst maintaining unchanged the principle of recycling the fluid from the outer tank to the inner tank, under a certain pressure, for example, at a pressure ranging from approximately 0.5 atm. to approximately 3 or more atm, directing the jets of fluid towards the inside space of the anode and slantingly or perpendicularly towards the surface of the bar to be chromium-plated. It is also pointed out that, although the method of this invention has been described with reference to an apparatus provided with a double tank, due to the fact that for very large pieces, such apparatus has proved to date to be the best solution, it is not excluded that, for other applications, apparatuses with a single chromium-plating tank or several tanks placed in line may be used; the chromium-plating fluid would be recycled in the previously described manner, taking it directly from the same bath within the chromium-plating tank.

What is claimed is:

1. A method for removing hydrogen in continuously chromium-plating of bars and the like, in which the bar is moved forward along a rectilinear path and through an anode immersed in a chromium-plating bath, and in which the level of the fluid in the chromium-plating bath is kept at a constant height by recycling the chromium-plating fluid of the aforesaid bath, the improvement comprising the steps of recycling the fluid of the chromium-plating bath feeding it directly into the space within the chromium-plating anode and directing a jet of chromium-plating fluid under pressure, towards surfaces of the aforesaid bar.

2. A method as claimed in claim 1, in which the jets of chromium-plating fluid are upwardly directed from below the anode against the surfaces of the bar to be chromium-plated.

3. A method as claimed in claim 1, in which the jets of chromium-plating fluid are fed on a slanting direction with the axis of the bar to be chromium-plated.

4. A method as claimed in claim 1, in which chromium-plating fluid is fed at a pressure ranging from approximately 0.5 to 3 atm.

5. An apparatus for the continuously chromium-plating of bars and the like, for carrying out a method for removing hydrogen, the apparatus comprising a first inner tank containing a chromium-plating bath, placed within a second tank outside the first, the tanks having lateral walls with apertures for passage of the bars, said apertures being aligned with an anode having apertures immersed in the chromium-plating bath, and sealing means in correspondence with the apertures in the aforesaid walls, said sealing means comprising chambers for collecting the chromium-plating fluid passing through the seals themselves and means for conveying it into the outer tank and further comprising a cylindrical body for supporting at least two sets of flexible sealing elements axially spaced apart from one another and removably fixed to the wall of the tank, and spacing elements arranged within the aforesaid cylindrical body, the flexible sealing elements being held tight, by the action of an outer thrust flange, between the opposing edges of two adjacent spacers, said spacers and said supporting body presenting on the bottom thereof outlet apertures for the chromium-plating fluid, and a system for recycling the chromium-plating fluid under pressure, from the outer tank to the inner tank, said recycling system comprising nozzles placed in correspondence with apertures in the anode, facing towards the inside of the anode itself and towards the bar to be chromium-plated.

6. An apparatus as claimed in claim 5, in which each recycling nozzle is connected to a respective chromium-plating fluid feeding pump.

7. An apparatus as claimed in claim 5, in which the nozzles are situated beneath the chromium-plating anode, and in line with the axis of the anode itself.

8. An apparatus as claimed in claim 7, in which the anode consists of parallel rods circumferentially arranged, angularly spaced apart from one another.

9. An apparatus as claimed in claim 8, in which, for bars to be chromium-plated which prevalently have a profile with a polygonal cross-section, the rods of the chromium-plating anode have a circular section and are arranged in correspondence with the sides and far from the longitudinal corners of the bar.

10. An apparatus as claimed in claim 8, in which, for bars to be chromium-plated which prevalently have a profile with a circular cross-section or the like, the chromium-plating anode consists of rectangular section rods.

* * * * *